US007086943B2

(12) United States Patent
Mugnolo et al.

(10) Patent No.: US 7,086,943 B2
(45) Date of Patent: Aug. 8, 2006

(54) SYSTEM AND METHOD FOR PLAYING BLACKJACK

(75) Inventors: Frank Mugnolo, Bellwood, IL (US); Michael Cyrkiel, Henderson, NV (US)

(73) Assignee: Casino Gaming, LLC, Bellwood, IL (US)

( * ) Notice: Subject to any disclaimer, the term of this patent is extended or adjusted under 35 U.S.C. 154(b) by 19 days.

(21) Appl. No.: 10/215,051

(22) Filed: Aug. 8, 2002

(65) Prior Publication Data

US 2004/0029628 A1 Feb. 12, 2004

(51) Int. Cl.
*A63F 1/00* (2006.01)

(52) U.S. Cl. ..... 463/12; 463/11; 463/13; 463/30; 463/31; 273/292

(58) Field of Classification Search ..... 463/1, 463/12–25, 40–42; 273/292, 274, 309
See application file for complete search history.

(56) References Cited

U.S. PATENT DOCUMENTS

| | | | | |
|---|---|---|---|---|
| 4,651,997 | A | 3/1987 | Wood | |
| 5,013,049 | A | 5/1991 | Tomaszewski | |
| 5,072,946 | A | 12/1991 | Miller | |
| 5,098,107 | A | 3/1992 | Boylan et al. | |
| 5,141,234 | A | 8/1992 | Boylan et al. | |
| 5,174,579 | A * | 12/1992 | Griffiths | 273/292 |
| 5,248,142 | A | 9/1993 | Breeding | |
| 5,257,789 | A * | 11/1993 | LeVasseur | 273/309 |
| 5,257,810 | A | 11/1993 | Schorr et al. | |
| 5,275,415 | A | 1/1994 | Wisted | |
| 5,275,416 | A | 1/1994 | Schorr et al. | |
| 5,280,915 | A | 1/1994 | Groussman | |
| 5,288,081 | A | 2/1994 | Breeding | |
| 5,314,193 | A | 5/1994 | Ferrer | |
| 5,320,356 | A | 6/1994 | Cauda | |
| 5,364,105 | A | 11/1994 | Jones | |
| 5,366,228 | A | 11/1994 | Kangsanaraks | |
| 5,454,570 | A | 10/1995 | Karal | |
| 5,538,252 | A | 7/1996 | Green | |
| 5,549,300 | A | 8/1996 | Sardarian | |
| 5,615,888 | A | 4/1997 | Lofink et al. | |
| 5,632,485 | A * | 5/1997 | Woodland et al. | 273/292 |

(Continued)

FOREIGN PATENT DOCUMENTS

CA 2281350 * 3/2002

OTHER PUBLICATIONS

"Scarne's Encyclopedia of Card Games," John Scarne, (c) 1983, HarperCollins Publishers, pp. 278-288.*

(Continued)

*Primary Examiner*—Xuan M. Thai
*Assistant Examiner*—Matthew D. Hoel
(74) *Attorney, Agent, or Firm*—Baniak Pine & Gannon

(57) ABSTRACT

After players make their wagers, a dealer deals hands comprised of two cards to each player and a hand comprised of two cards to himself. When the player's hand as dealt has a predetermined point value (or one of a plurality of predetermined point values), the player is offered an early payout option. If the early payout option is elected, the player receives a portion of the original wager. In one embodiment, the early payout option is offered only when the dealer's hand is not a natural. In another embodiment, the early payout option is offered only if the dealer's face up card is a predetermined value (or one of a plurality of predetermined point values), such as ten.

13 Claims, 3 Drawing Sheets

U.S. PATENT DOCUMENTS

| | | | | |
|---|---|---|---|---|
| 5,743,532 | A * | 4/1998 | Lafferty | 273/292 |
| 5,791,989 | A * | 8/1998 | Slinkman | 463/12 |
| 5,810,360 | A * | 9/1998 | Srichayaporn | 273/292 |
| 5,816,575 | A * | 10/1998 | Keller | 273/292 |
| 5,836,586 | A * | 11/1998 | Marks et al. | 273/292 |
| 5,988,644 | A * | 11/1999 | Cyrkiel | 273/292 |
| 6,000,699 | A * | 12/1999 | Long | 273/292 |
| 6,095,525 | A * | 8/2000 | Terminel | 273/274 |
| 6,158,741 | A * | 12/2000 | Koelling | 273/292 |
| 6,182,969 | B1 * | 2/2001 | Green | 273/292 |
| 6,237,917 | B1 * | 5/2001 | Timpano | 273/292 |
| 6,279,910 | B1 * | 8/2001 | de Keller | 273/292 |
| 6,293,551 | B1 * | 9/2001 | Webb | 273/292 |
| 6,296,251 | B1 * | 10/2001 | Webb | 273/292 |
| 6,305,690 | B1 * | 10/2001 | Webb | 273/292 |
| 6,311,978 | B1 * | 11/2001 | Moody | 273/292 |
| 6,322,075 | B1 * | 11/2001 | DeFranco | 273/274 |
| 6,336,635 | B1 * | 1/2002 | Baer | 273/292 |
| 6,375,190 | B1 * | 4/2002 | Kocher | 273/303 |
| 6,416,406 | B1 * | 7/2002 | Duhamel | 463/12 |
| 6,422,565 | B1 * | 7/2002 | Daines | 273/292 |
| 6,450,500 | B1 * | 9/2002 | Miller | 273/292 |
| 6,540,230 | B1 * | 4/2003 | Walker et al. | 273/292 |
| 6,598,879 | B1 * | 7/2003 | Spur et al. | 273/292 |
| 6,604,741 | B1 * | 8/2003 | Snow | 273/292 |
| 6,612,580 | B1 * | 9/2003 | Weldon | 273/292 |
| 6,679,497 | B1 * | 1/2004 | Walker et al. | 273/292 |
| 6,726,427 | B1 * | 4/2004 | Jarvis et al. | 413/12 |
| 6,773,013 | B1 * | 8/2004 | Caldwell | 273/292 |
| 2001/0000933 | A1 * | 5/2001 | Koelling | 273/292 |

OTHER PUBLICATIONS

"The Everything Casino Gambling Book," Meg Elaine Schneider, (c) 2004, Adams Media, Avon, Mass., pp. 37-52.*

John Brokopp's review of Casino Surrender (TM), Chicago Sun-Times, Dec. 2, 2005, www.suntimes.com/output/gaming/wkp-news-bet021.html, downloaded, Feb. 23, 2006.*

John Grochowki's review of Casino Surrender (TM), Casino City Times, Nov. 22, 2005, grochowski.casinocitytimes.com/articles/23133.html, downloaded Feb. 23, 2006.*

Appendices 1, 5, and 15 of www.wizardofodds.com, section on Black Jack relating to Casino Surrender (TM), www.wizardofodds.com/blackjack/appendix1.html, "/appendix5.html, "/appendix15.html, downloaded Feb. 23, 2006.*

Guarantee20 Procedure Manual.

Dealer Training—Guarantee 20 (Videotape).

* cited by examiner

SYSTEM AND METHOD FOR PLAYING BLACKJACK

FIELD OF THE INVENTION

This invention is in the general field of casino gaming and, more particularly, relates to the game of Black Jack.

BACKGROUND OF THE INVENTION

Black Jack is one of the most widely popular card games in casinos. There are many variations of the game played throughout the world. In general, the game utilizes a table with a semi-circular top that has a felt covering which carries images of player stations (typically a total of seven) spaced along the table top's arcuate edge. A dealer is usually seated adjacent to the straight edge of the table top (opposite the arcuate edge). The game can also be played on a computer or on a video gaming machine where the cards are computer generated and displayed to the player on a terminal.

As many as seven players (or the total number of player stations) or as few as one player may play at the table adjacent to a player station. Accordingly, each player has an exclusive access to one of the stations. When the game is implemented on a computer the game is typically played by one player against the computer although internet based Black Jack games may allow multiple players at the same virtual table.

The game is played with at least one standard deck of cards and may be played with multiple decks. Most casino Black Jack tables use six to eight standard decks of cards. Each card has a point value. An ace has a point value of either 1 or 11. Kings, queens and jacks have a point value of 10. All other cards have a point value equal to their nominal value. The cards are shuffled together and dealt by the dealer. Typically, when multiple decks are being used, the dealer deals from a shoe.

Each station includes an image marking an area for players to place bets (typically a circle). Before any cards are dealt, each player makes a wager by placing chips representative of the wager within the betting area at the player's station. Some casinos allow players to make wagers by placing cash within the betting area. Of course, in video or computer versions of Black Jack, there are many different ways for a player to place a bet. By way of example, a number representing the value of a wager amount may be displayed on a terminal screen or a video representation of chips that represent the wager may be displayed on an area of the screen. After the wagers are made, the dealer deals a first card to each of the players and to himself. The dealer then deals a second card to each of the players and a second card to himself whereby each of the players and the dealer have a hand comprised of two cards. Typically, each of the cards dealt to the players are dealt face up. At some tables, the player's cards are dealt face down. One of the cards dealt to the dealer is usually dealt face up (usually the first card) and the other card is usually dealt face down. The card that is dealt face down to the dealer (usually the second) is often referred to as the hole card.

Some casinos, mostly in Europe, give the dealer only one card face up until all the players have finished their hands. The dealer then deals his second card, and finishes his hand. This is sometimes called the European No Hole Card rule.

A point value of a hand is the sum of the point values of cards comprising the hand. The player's object is to acquire a hand whose point value is as close to 21 as possible, without exceeding 21. When the point value of the player's hand exceeds 21, the player loses his wager.

When the dealer's face up card has a point value of 10 or is an ace, the dealer typically looks at the hole card. When the sum of the point values of the dealer's first card and hole card is 21 (referred to as a "natural"), the dealer has "Black Jack". Similarly, a player has "Black Jack" when he is dealt a natural.

If the dealer's face up card is an Ace, he will typically offer "Insurance" to the players before dealing the players any cards in addition to the initial two cards. Insurance bets can be made by betting up to half the player's original bet amount. An insurance bet is typically placed in an insurance betting stripe in front of the initial bet. This can be done in various ways in video or computer versions of Black Jack. The dealer will check to see if he has a 10-value card underneath his Ace, and if he does have Blackjack, the winning Insurance bet will be paid at odds of 2:1. The player loses his original bet of course (unless he also has a Blackjack), so the net effect is that the player breaks even (assuming the player bet the full half bet for insurance.) This is why the bet is described as "insurance", since it seems to protect the player's original bet against a dealer Black Jack. Of course, if the dealer does not have Black Jack, the player loses the insurance bet, and still has to play the original bet out. In the simplest description, Insurance is a side-bet, where the player is offered 2:1 odds that the dealer has a 10-valued card underneath ("in the hole") when the dealer is showing an Ace.

When the dealer and the player both have naturals, there is no payout; the player retrieves the wager. This is often referred to as a "push". When the dealer has a natural and the player does not have a natural, the dealer collects the wager. When the dealer does not have a natural and the player has a natural, the player usually receives a 3 to 2 payout on the wager.

When the dealer's hand is not a natural and a player's hand has a point value of less than 21, the player may elect to have his hand augmented by one or more additional cards. When a player chooses to receive an additional card, this is commonly referred to as asking for a "hit". A player can ask for a hit one or more times until the hand has a point value of 21 or greater. When a player does not want any further cards, this is commonly referred to as "standing". Thereafter, a player who has a hand with a point value of 21 or less is referred to as a surviving player. If the point value of the hand is over 21, the player loses his bet and is said to have "busted". Other options that are also commonly available are splitting and doubling down. A player may split a hand when he is dealt a matching pair of cards. Electing to split results in the hand being split into two separate hands that are played independently. Doubling down can usually only be done with a two card hand, before another card has been drawn. Doubling down allows the player to double his bet and receive one, and only one, additional card to the hand. Player's are typically allowed to double down for "less" and place a bet of less than double the original bet.

Some casinos offer an option called surrender. This option can fall into two categories: early and late. Surrender offers the player the choice to fold his hand, at the cost of half of the original bet. The player must make that decision prior to taking any other action on the hand. For example, once the player draws a third card, splits or doubles down, surrender is no longer an option. The two varieties of surrender, early and late, differ only in the way a dealer Black Jack is handled. In an early surrender game, a player may choose to surrender before the dealer checks his cards for a Black Jack, offering a cheap way out even if the dealer turns out to have a Black Jack. A much more common variation is late surrender, where the dealer checks for Black Jack first, and then only if he does not have Black Jack will the dealer allow players to surrender their hands.

Another variation to the game of Black Jack is described in U.S. Pat. No. 5,988,644, entitled "Method of Playing a Card Game", which names a common inventor to the present application. This patent is hereby incorporated by reference. The assignee of the present application has been marketing a variation to Black Jack that is based on the content of U.S. Pat. No. 5,988,644 under the name Guarantee 20®. This variation works as follows. The dealer deals both cards to himself face down. If a player is initially dealt two cards with a point value of twenty, the player has the option of moving his original wager to a separate betting area to make the Guarantee 20® wager. The dealer then turns over one card. If the dealer's face up card is not an Ace or a ten, a player who made the Guarantee 20® wager is paid one half of his wager and his cards are removed. If the dealer's up card is an Ace or a ten, the dealer checks to see if he was dealt a natural. If so, a player who made the Guarantee 20® wager is paid 1.5 to 1 on his bet. If the dealer does not have a natural, those players who made the Guarantee 20® wager are paid one half of their wager and those who did not are given a second chance to make the Guarantee 20® wager. If a player takes the second chance, he is immediately paid one half of his wager and his cards are removed. This modification to Black Jack requires a modification to the typical fashion in which cards are dealt because both of the dealer's cards are dealt face down as opposed to one face down and one face up.

After the player's have made their election (e.g., double down, split, hit one or more times and stand, or initially stand), the dealer exposes his hole card. When the dealer's hand has a point value of 16 or less, the dealer must continue to augment his hand with additional cards until the point value of the dealer's hand is greater than 16. When the dealer's final hand has a point value greater than 21, the dealer is said to have "busted" and makes a one to one payout on the wager of each of the surviving players.

The dealer may not augment his hand when it has a point value greater than 16. In other words, when the dealer's hand has a point value in a range of 17 to 21, it is the dealer's final hand. In some variations, a dealer must augment his hand when he has a "soft" 17—which occurs when the hand is comprised of an Ace and a Seven card.

Each of the surviving players wins a one to one payout on their wager when they have a hand with a point value greater than the point value of the final hand. Conversely, each of the surviving players loses his wager when he has a hand with a point value less than the point value of the final hand. A surviving player recovers his wager when he has a hand with a point value equal to the point value of the final hand (he is commonly said to have "pushed").

Casinos make money by offering Black Jack because the rules result in the casino receiving a slight advantage (sometimes lower than two percent) over the players. With a large volume of bets over time, the casino will reap large rewards. In light of this, it is advantageous to casinos to offer bets which attract players and which provide the casino with an edge—even if it is a very slight edge. It is also advantageous to casinos for the various bets to be simple from the perspective of the dealer so that the game can be dealt and played in an efficient and quick manner. Players, on the other hand, typically play the game for shorter periods of time than the house or casino (which is in theory always open). Accordingly, players may focus less on the statistical averages and more on "gut" feeling when making playing decisions. One frustrating aspect of play that a player must endure is having a hand comprised of two cards with a high point value (such as 20) and losing because the dealer has a natural or because the dealer draws a better hand (such as a 21). It is therefore desirable to offer options that maintain or enhance the casino's edge in Black Jack while also providing more flexibility to the player and attracting more play.

DETAILED DESCRIPTION OF THE PRESENTLY PREFERRED EMBODIMENTS

The preferred embodiment(s) of the present invention is a modification to the traditional game of Black Jack that enhances the experience of the player and contributes to the profitability of the house or casino. The term "house" is used herein to mean whatever entity the player is playing against, such as the casino. The modification is simple and can be accomplished without a significant impact upon the speed of the game. The following description is presented to enable a person of ordinary skill in the art to make and use the invention, and is provided in the context of a particular application and its requirements. Various modifications to the preferred embodiment will be readily apparent to those skilled in the art, and the generic principles defined herein may be applied to other embodiments and applications without departing from the spirit and scope of the invention. Thus, the present invention is not intended to be limited to the embodiment shown, but is to be accorded the widest scope consistent with the principles and features disclosed herein.

Figure 1:
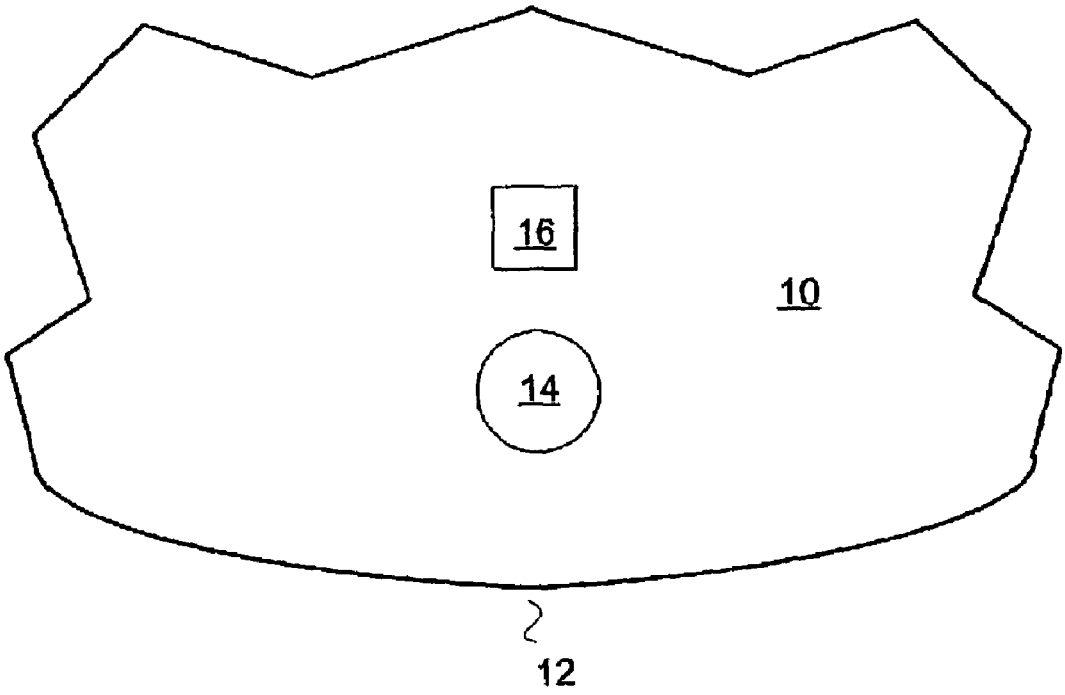
FIG. 1 is a plan view of a covering of the top of a Black Jack table which can of be used with a preferred embodiment.

To help illustrate the preferred embodiment(s), this description will refer to FIG. 1, which shows the image of an example player station on a typical Black Jack table. Player station 10 is one of a plurality of images of player stations printed on a felt covering of the top a semicircular Black Jack table. More particularly, the stations are preferably evenly spaced adjacent to an arcuate edge 12 of the table. A player (not shown) is seated adjacent to the station 10. Other players may be similarly seated adjacent to respective player stations. A dealer (not shown) stands adjacent to a straight edge (not shown) of the table. The image includes a circle 14 wherein chips or cash representative of a wager are placed by the player before the cards are dealt. The invention is not limited to any particular configuration of a gaming table.

Although FIG. 1 depicts and the following description focuses on a typical physical Black Jack table where players sit, the invention is not so limited. For example, the game can be implemented "virtually" on a computing device, such as a video gaming terminal or on a personal computer where the computer deals the cards and where the cards are represented by images displayed on a video terminal. The game can be running on a dedicated computing device located, for example, on the floor of a casino or can be offered on a server which can be accessed by players through the internet (e.g., internet based casinos).

Figure 3:
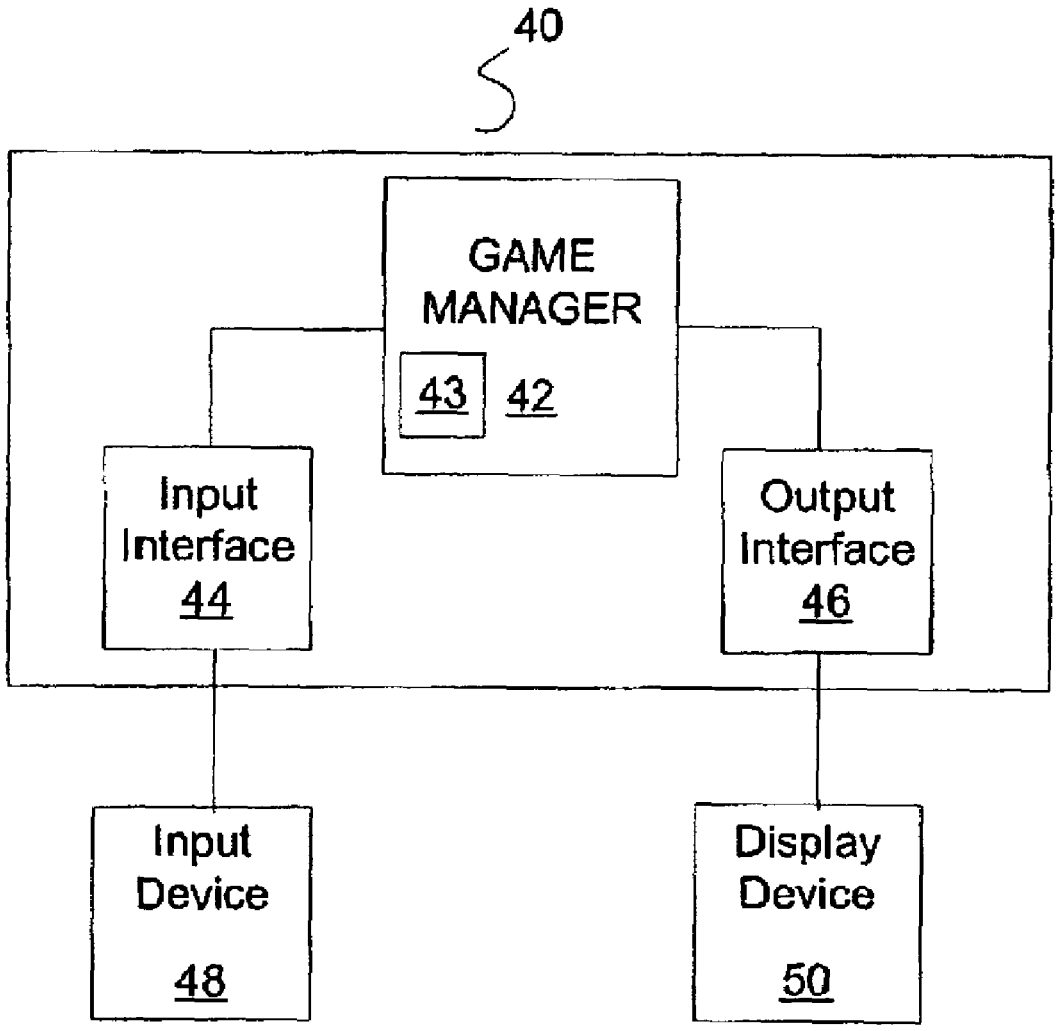
FIG. 3 is an example architecture of an embodiment in which the game of the present invention is implemented electronically.

Such an arrangement is illustrated in FIG. 3. As shown in FIG. 3, the modification to Black Jack in its various forms described herein can be implemented on a computing device 40. The computing device 40 can be any computing device such as a personal computer, a dedicated video game on the floor of a casino, a handheld computing device, a server or computer connected to the internet or a network (by any method of connecting two or more computing devices), etc. Such computing devices generally include a central processing unit (CPU) (not shown) such as a microprocessor, a microcontroller, or any device that performs arithmetic, logic or control operations and a storage device (not shown) such as a magnetic disk, an optical disk, or any other volatile (e.g., Random Access memory ("RAM")) or non-volatile firmware (e.g., Read Only Memory ("ROM")) storage system readable by the central processing unit. The computing device 40 includes a game manager 42. The game manager 42 comprises the logic that manages the Black Jack game. For example, the game manager 42 is programmed to establish the virtual or electronic deck of cards to be dealt and deals the cards (which comprise data stored in the computing device and may be represented by graphics or text displayed to a player). The game manager 42 also manages a game by accepting input from players (such as wagers, decisions to hit, stand, etc.), by determining winners and losers, and providing instructions relating to payouts. The game manager 42 preferably interfaces with an input device 48 via an input interface 44. The invention is not limited to any particular type of input device and can include a keyboard, a mouse, physical buttons on a video gaming device, virtual buttons generated on the display of a video gaming device, etc. The game manager 42 also preferably interfaces with a display device 50 via a display interface 46. The invention is not limited to any particular type of display device can include any type of monitor. The game manager 42 preferably includes an early payout processor or logic 43 that implements the modification (in its various forms) to Black Jack described herein. The early payout processor or logic 43 can be a separate module or can be integrated into the game manager 42. The input device 48 and the display device 50 can be directly connected to the computing device 40 or can be connected via a network connection (such as the internet). Also, although the various blocks shown in FIG. 3 are shown separately, various portions of those blocks can be combined or separated into further blocks as known by one of ordinary skill in the art. For example, the game manager 42 can be distributed across multiple computing devices. In addition, the game manager 42 can be implemented in software or hardware.

Figure 2:
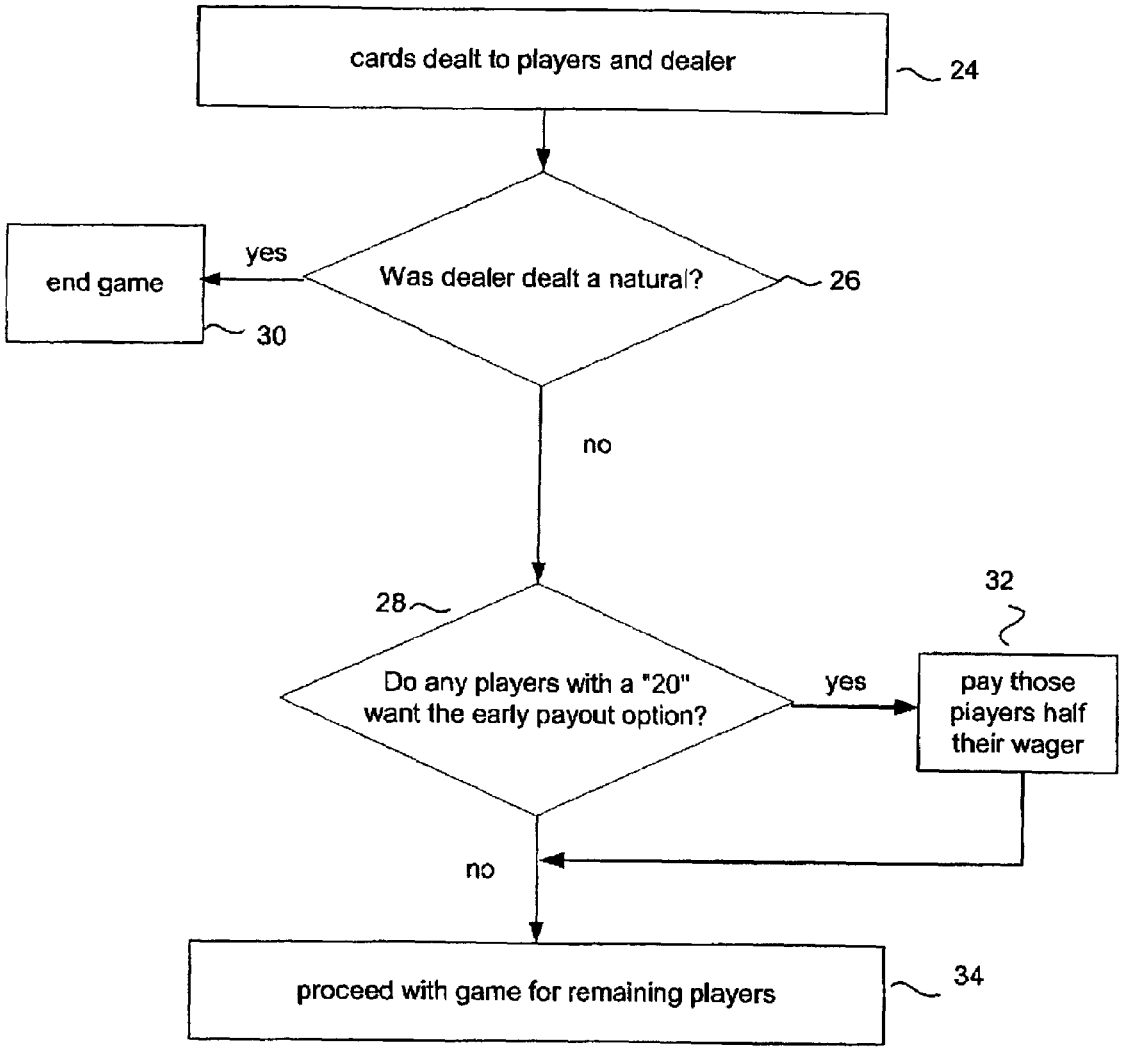
FIG. 2 is a flow chart illustrating the steps of a preferred embodiment of the game of the present invention.

A preferred embodiment of the invention is illustrated in FIG. 2. The flow chart shown in FIG. 2 provides only an example of one embodiment and it should be understood that more or fewer steps may be utilized or the steps may occur in one or more orders that are different from the order of steps shown in FIG. 2 without departing from the spirit of the invention. For example, rather than examining whether the dealer was dealt a natural before offering certain players the option of forcing the casino to surrender (as shown at block 26 of FIG. 2), the game could provide that such a step be performed after the step shown at block 28. There are many other examples, too numerous to mention here.

After the wagers are placed, the dealer deals hands to the players and himself as shown at block 24. Each player hand is comprised of two cards. The dealer's hand also typically is comprised of two cards (but, could initially be just one card as is the case in games following the European No Hole card rule). The cards may be dealt from a shoe (or in the case of a video or computer version, from a virtual shoe), which typically contains six to eight standard decks of cards that are shuffled together. The cards may alternatively be dealt from the dealer's hands. When this is done, the dealer typically shuffles a smaller number of decks together, such as one or two decks. In the preferred embodiment, one of the dealer's cards is dealt facing down (the hole card) and the other card is dealt facing up (the up card). In another embodiment, both of the dealer's cards are dealt face down and one is flipped over before play continues.

Next, if the dealer's up card is has a value of ten or is an Ace, the dealer preferably examines the hole card to see if he was dealt a natural Black Jack as shown at block 26. If the dealer's up card is an Ace, the dealer will also typically offer insurance to the players. As shown at block 30, if the dealer was dealt a natural the game is preferably finished. When this happens, the dealer collects all of the players' wagers except for any players who were also dealt a natural. Any player who was dealt a natural keeps his original bet and is said to have "pushed".

If the dealer was not dealt a natural, any player who was dealt a hand with a predetermined point value is given the opportunity to elect to receive a predetermined payout and end the game for that player, as shown at block 28. In effect, the player is forcing the casino to surrender by folding its hand with respect to that player. In a preferred embodiment, the predetermined point value is 20 and the predetermined payout is one half of the player's bet. Hereinafter, this election shall be referred to as the "early payout option." The early payout option is preferably offered to a player before the player takes any other action associated with his hand. This does not preclude, however, a player taking an action associated with the dealer's hand (such as an insurance bet when the dealer's face up card is an Ace) before electing the early payout option. The invention is not limited to any particular manner in which a player indicates a desire to take the early payout option. For example, if the game is being played on a computing device, the player could indicate a desire to take the option by pressing a button (either physical or on the video screen). In addition, while this embodiment provides the player with the early payout option if he was dealt a hand with a point value of twenty, the invention is not so limited. The early payout option can be offered to players based on any predetermined point value or values. In an alternative embodiment, the step shown at block 26 need not be performed prior to the step shown at block 28 and a player with a hand of a predetermined point value could be given the early payout option even before the dealer checks to see if he was dealt a natural. In games following the European No Hole card rule, this alternative would be necessary.

In a preferred embodiment, the early payout option (shown at block 28) is not provided unless the dealer has an up card with a value of ten. The present invention is not limited to providing the early payout option only when the dealer has a particular up card.

As shown at block 32, for a player who elects the early payout option, that player is paid a portion of the amount of his wager (preferably half) and the game is ended for that player (and his cards are collected). The player may be paid the portion of the wager at the time the player makes the early payout option or after the game is finished for all players at the table. Referring back to FIG. 1, in a preferred embodiment, when a player elects this option, the dealer places the winning amount of the wager (preferably fifty percent) in a box 16 adjacent to the betting circle 14. Putting the early payout winnings in a separate box provides clear confirmation of the election of the early payout option to casino supervisors and to casino surveillance. The invention is not limited, however, to any particular approach or technique for how the winning wager is paid out. For example, the winning wager could simply be put next to the original wager without any need to modify the images on a standard Black Jack table. Some further examples include paying out the winning wager immediately or crediting it for later payout if the game is implemented on a video gaming machine or crediting the winning wager to an account if the game is implemented on an internet gaming device. Next, as shown at block 34, the game proceeds for all remaining players. Using an eight deck shoe following the standard Las Vegas Black Jack rules, the above described modification to Black Jack results in an overall house advantage of approximately 5.76 percent when the early payout option is selected by the player where the option is allowed only if the dealer has an up card with a value of ten (and when the player is dealt a hand with a point value of twenty). This statistic assumes that an early payout is 50% of the original wager. Similarly, using a six deck shoe, the overall house advantage is approximately 5.86%. This conclusion was based on a probabilistic analysis of the expected distribution of the dealer's final hands and the player's expectation. With the player's two cards (two cards with a value of ten or an Ace and a Nine) and the dealer's up card of with a value of ten removed from the deck, the dealer's probability of reaching various totals was determined by hitting the dealer's hand from the remaining shoe until the dealer either had a 17 or above or until the dealer busted. That analysis provided the following results shown in Tables 1 and 2 below:

For an eight deck shoe:

TABLE 1

| | Player's First Two Cards | | |
|---|---|---|---|
| | T-T | A-9 | T-T or A-9 |
| Frequency Dealer' Final Hand Distribution with a 10 up | 2.8658 | 0.3668 | 3.2326 |
| 17 | 12.1979 | 12.1309 | 12.1903 |
| 18 | 12.1778 | 12.138 | 12.1773 |
| 19 | 12.2004 | 11.8988 | 12.1661 |
| 20 | 36.5913 | 37.0112 | 36.6389 |
| 21 | 3.805 | 3.7669 | 3.8007 |
| bust | 23.0277 | 23.0542 | 23.0307 |
| Player's Expectation | 55.7987 | 55.4551 | 55.7597 |
| House Advantage | 5.7987 | 5.4551 | 5.7597 |

A player will be delt a hand of twenty 3.2326% of the time. When this happens, overall the dealer will end up with a hand of seventeen to nineteen or bust 59.5604% of the time (in which case the player would have won his entire wager) with a hand of twenty 36.6389% of the time (in which case the player would have pushed) and with a hand of twenty-one 3.8007% of time (in which case the would have lost his entire wager).

For a six deck shoe:

TABLE 2

| | Player's First Two Cards | | |
|---|---|---|---|
| | T—T | A-9 | T—T or A-9 |
| Frequency Dealer' Final Hand Distribution with a 10 up | 2.85 | 0.3677 | 3.2177 |
| 17 | 12.2407 | 12.151 | 12.2305 |
| 18 | 12.2138 | 12.1605 | 12.2077 |
| 19 | 12.2441 | 11.8412 | 12.1981 |
| 20 | 36.4298 | 36.9911 | 36.4939 |
| 21 | 3.8279 | 3.7767 | 3.822 |
| bust | 23.0437 | 23.0795 | 23.0478 |
| Player's Expectation | 55.9145 | 55.4555 | 55.8621 |
| House Advantage | 5.9145 | 5.4555 | 5.8621 |

Thus there is described herein a variation of Black Jack where a player has an option of being guaranteed a payout when a hand formed by the first two cards dealt to the player has a predetermined point value. This variation is simple to implement and should not appreciably effect the speed of the game. The preferred embodiment of the invention described herein results in an edge to the house/casino. It should be noted, however, that the present invention is not limited to situations where the variation results in an edge to the house. The statistics described above only illustrate the probabilities associated with a particular embodiment of the game—where the early payout option 50% of the wager, is limited to a player hand of twenty and where the option is given only after the dealer checks for Black Jack and only when the dealer has an up card of ten. The probabilities would differ, of course, if other embodiments of the game were implemented.

It should be understood that the above description of the preferred embodiment, alternative embodiments, and specific examples are given by way of illustration and not limitation. For example, the features described herein could be incorporated into any variation of the game of Black Jack. Many changes and modifications within the scope of the present embodiments may be made without departing from the spirit thereof, and the present invention includes all such changes and modifications.

We claim:

1. A method of playing a variation of the game of Black Jack where a player makes a wager against a house, comprising the steps of:

dealing a hand of two cards to a player;

dealing a card to the house wherein the card is face up before the player has the option to take any action associated with the first hand;

giving the player an option to accept a payout equal to a portion of the wager before the player takes any other action associated with the first hand if the player's hand has a value of twenty and if the house card has a value of ten;

upon the player electing the option to accept the payout, ending play of the hand; and paying to the player the payout.

2. The method of claim 1 wherein the portion is one half of the wager.

3. The method of claim 1 further comprising the step of collecting the player's cards after a payout is made.

4. The method of claim 1 further comprising the step of dealing a hole card to the house.

5. The method of claim 4 wherein the card is dealt face up and the hole card is dealt face down.

6. The method of claim 5 further comprising the step of examining the hole card if the face up card has a value of ten or is an Ace to determine if the house has a natural Black Jack.

7. The method of claim 6 wherein the step of giving the player the option to accept the payout is only given to the player if the house is not a natural Black Jack.

8. The method of claim 1 wherein the steps are performed by program instructions stored on a computer-readable medium and wherein the cards are represented graphically on a visual display.

9. A system for providing a variation to the game of Black Jack where a player makes a wager before cards are dealt by a house, comprising:

a game manager that deals at least one card to a virtual dealer and a virtual hand of cards to a player and that monitors wagers, wherein the at least one card dealt to the dealer is face up before the player has the option to take any action associated with the virtual hand;

an early payout processor that provides the player the option to elect to receive a payout of a portion of the wager before the player takes any action associated with the virtual hand when the virtual hand that was dealt to the player has a value of twenty and the face up card of the virtual dealer has a value of ten and that provides such a payout to the player and ends play of the virtual hand when the option has been elected.

10. The system of claim 9 further comprising:

a display device for displaying the dealt cards to the player; and an input device that allows the player to input playing decisions.

11. A method of playing a card game comprising the steps of:

a player making a wager;

dealing a hand of two cards to the player;

dealing a hand of two cards to a dealer, wherein at least one of the two cards of the hand dealt to the dealer is face up before the player has the option to take any action associated with hand of to cards dealt to the player;

determining if the dealer was dealt a natural;

if the dealer was not dealt a natural, providing the player an option to accept a payout, before the player takes any other action associated with the player's hand, equal to a portion of the wager if the player's two card hand has a point value of twenty and if the face up card of the dealer has value of ten;

upon the player electing the option to accept a payout, ending play of the player's hand; and paying to the player the payout equal to a portion of the wager.

12. The method of claim 11 wherein the portion of the wager is one half of the wager.

13. The method of claim 11 wherein the player makes the wager by placing the wager in a first area and wherein the step of paying the payout further comprises placing the payout in a second area.

* * * * *